US005252025A

United States Patent [19]

Kida et al.

[11] Patent Number: 5,252,025

[45] Date of Patent: Oct. 12, 1993

[54] DRAINAGE PUMP

[75] Inventors: Nobuo Kida; Kenji Kiyota; Akira Yonei; Hiroshi Oya, all of Takasago, Japan

[73] Assignee: Mitsubishi Jukogyo Kabushiki Kaisha, Tokyo, Japan

[21] Appl. No.: 776,779

[22] Filed: Oct. 17, 1991

[30] Foreign Application Priority Data

Feb. 25, 1991 [JP] Japan ..... 3-053474
Apr. 9, 1991 [JP] Japan ..... 3-031646[U]

[51] Int. Cl.[5] ..... F04B 11/00

[52] U.S. Cl. ..... 415/24; 415/115; 415/116; 417/36; 417/90

[58] Field of Search ..... 415/24, 115, 116.169.1, 415/182.1, 183, 208.1, 914; 417/36, 90

[56] References Cited

U.S. PATENT DOCUMENTS 1,047,134 12/1912 Oesterlen ..... 415/24
1,474,086 11/1923 Poebing ..... 415/24
2,262,191 11/1941 Moody ..... 103/111
5,074,746 12/1991 Konishi ..... 415/24

FOREIGN PATENT DOCUMENTS 211771 11/1984 Japan ..... 415/24
1107603 5/1965 United Kingdom .
1184824 3/1967 United Kingdom .

*Primary Examiner*—John T. Kwon
*Attorney, Agent, or Firm*—Jacobson, Price, Holman & Stern

[57] ABSTRACT

A drainage pump (10) in which the portion near the entrance of the impeller (12) in the suction tube (11) is open to the set lowest suction water level (L.W.L.) through an air intake pipe (15), so that air is introduced into the portion near the entrance of the impeller (12) when the suction water level (W.L.) is lower than the preset lowest suction water level. An air intake hole (14) may also be provided through the water intake suction tube (11) near the impeller.

1 Claim, 9 Drawing Sheets

DRAINAGE PUMP

BACKGROUND OF THE INVENTION

This invention relates to a drainage pump, and more particularly a vertical shaft pump of all-level all-speed operation type which is operated at a constant speed irrespective of the suction water level.

The conventional vertical shaft pump used for rain water drainage is sometimes operated even when the water level at the suction side, namely the suction water level, is lower than a specified level in preparation for flooding. If the suction water level is low, air suction vortexes easily occur on the water surface on the suction side; as a result, the impulse of vortex produces vibration and noise, making the operation of the pump impossible. Therefore, various measures are taken to prevent vortexes on such a type of pump. FIG. 8 is a vertical cross sectional view of a conventional vertical shaft type axial flow pump. In this figure, when the suction water level W.L of intake chamber a is higher than the water level L.W.L corresponding to the limit suction water level at which a pump sucks water safely (critical submergence), a vertical shaft pump operates steadily at a speed of 100% because suction vortexes b are not produced. If the suction water level W.L is lower than the water level L.W.L, air suction vortexes easily occur on the water surface. When a pump is operated in the condition of the water level being lower than the water level L.W.L, the discharge rate of flow is limited by the reduction in rotational speed, or a splitter c is installed.

FIG. 9 is a front elevational view of another conventional vertical shaft type axial flow pump. On the vertical shaft pump shown in this figure, a suction tube d is longer than usual, an impeller e is mounted above the water level L.W.L corresponding to the limit suction water level, and a draining pipe f is installed immediately under the impeller e and connected to an air-water switching means g at the upper end. When the suction water level is above the water level L.W.L, the pump is operated steadily at a speed of 100%. If the suction water level becomes lower than the water level L.W.L, air is fed to a position immediately under the impeller e from the air-water switching means to perform the air-water separation because air suction vortexes b easily occur. Then, the pump is operated still at a speed of 100% under the condition of zero discharge, while the air and water are stirred.

As described above, when the suction water level W.L is below the water level L.W.L corresponding to the limit suction water level, speed reduction or air-water separation must be performed or a splitter must be installed for the conventional vertical shaft pump. For this reason, the conventional vertical shaft pump requires a control system for speed reduction, or requires a draining pipe f and an air-water switching means q. Although raising the position of the impeller e reduces vortexes, the water level at which pumping is started also rises, and the effective suction water depth of the vertical shaft pump decreases. Even if a splitter c is installed, the limit water depth h at which the pump does not suck air from the water surface on the suction side is about 1.2 times as large as the bore of the suction port d. To reduce this water depth h, it is necessary to restrict the pump discharge by controlling the rotational speed of the vertical shaft pump or the degree of opening of the discharge valve.

FIG. 10 is a view for explaining the construction of a conventional dry pit type pump. In this figure, this pump is installed outside an intake chamber a. The pump sucks water in the intake chamber through a suction tube i passing through the side wall of intake chamber a, pressurizes the water with an impeller j, and discharges it through the scroll chamber k. H.W.L denotes the highest level of water flowing into the intake chamber a, and L.W.L denotes the lowest water level at which the pump can operate safely without the occurrence of air suction vortexes or submerged vortexes.

On the above-described conventional dry pit type pump as well, air suction vortexes or submerged vortexes occur when the suction water level is lower than the lowest water level L.W.L, and vibration and noise may result because the pump sucks these vortexes. In such a case, it is necessary to decrease the discharge rate of flow or reduce the rotational speed.

SUMMARY OF THE INVENTION

An object of the present invention is to provide a drainage pump which can operate stably even when the suction water level is lower than a specified level.

To attain the above object, the drainage pump of this invention comprises an air intake pipe whose one end opens near the impeller in the suction tube and whose other end opens at the set lowest suction water level.

On this drainage pump, air is taken from the air intake pipe into the suction tube when the water level on the suction side is lower than a specified level. This reduces the discharge rate of flow from the pump, so that air suction vortexes are not generated on the water surface on the suction side.

Another drainage pump of this invention comprises a first branch pipe which is connected horizontally to the middle part of the suction tube and which rises vertically, a second branch pipe which communicates with this first branch pipe and branches horizontally at one end so as to be in communication with the impeller suction portion at one end and connects at the other end to the air intake pipe extending vertically and having its open end at a position higher than the highest suction water level, and a main valve disposed between the first and second branch pipes.

According to this invention, since the impeller suction portion is indirectly connected to the position corresponding to the suction water level requiring air suction, even a dry pit type pump can be operated in such a manner so as to make the best of the advantages of a wet pit type pump and preclude the entrance of foreign matters.

BRIEF DESCRIPTION OF THE DRAWINGS

The invention will now be described in detail with reference to the accompanying drawings wherein.

DETAILED DESCRIPTION OF PREFERRED EMBODIMENTS

Figure 1:
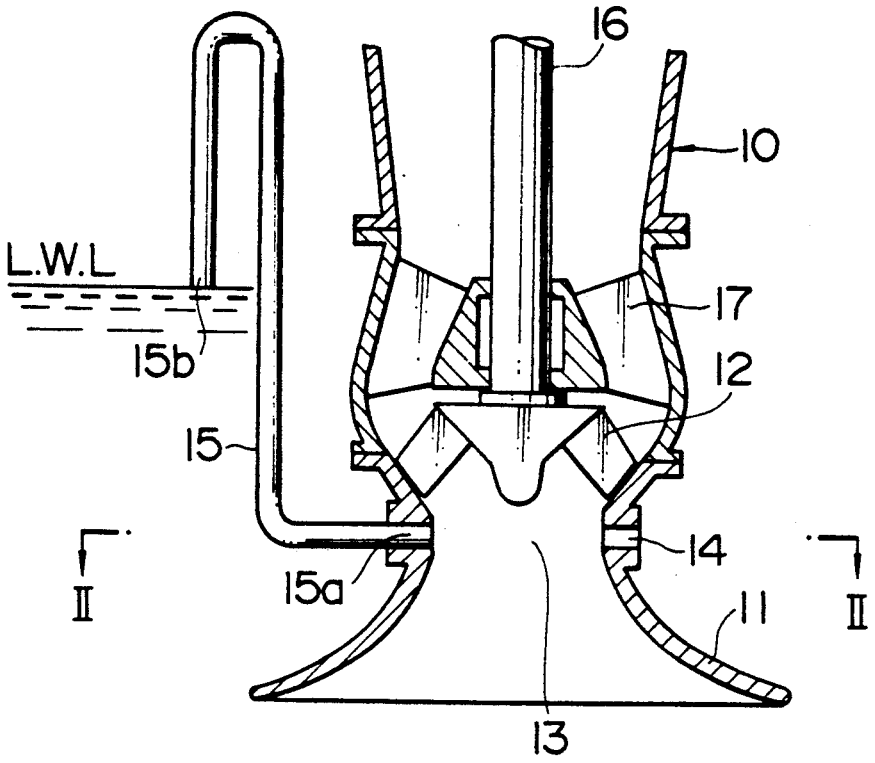
FIG. 1 is a longitudinal cross-sectional view of a first embodiment of vertical shaft type axial flow pump for drainage according to this invention.
Figure 2:
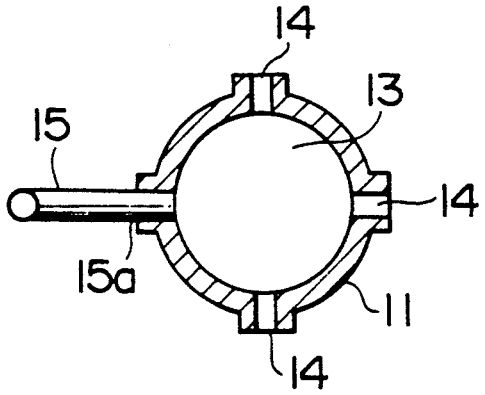
FIG. 2 is a cross-sectional view taken along the plane of line II—II of FIG. 1.
Figure 3A:
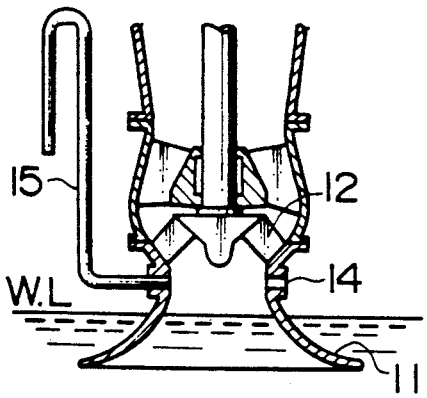
FIGS. 3(*a*)–(*g*) are schematic cross-sectional views for explaining the operation of the pump of the first embodiment.
Figure 3B:
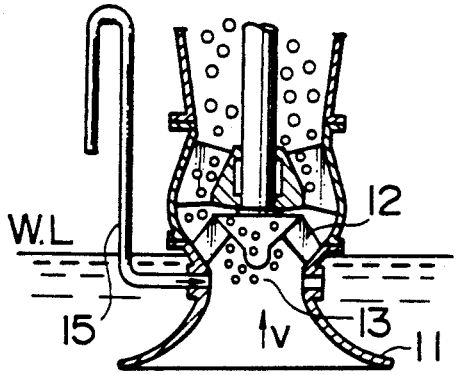
Figure 3C:
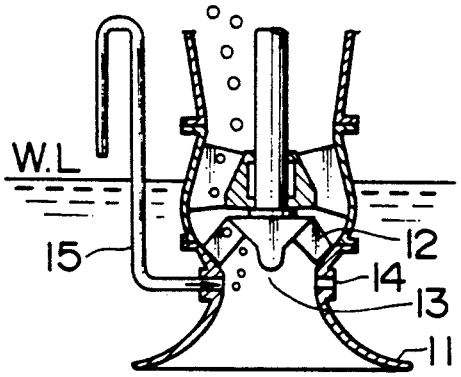
Figure 3D:
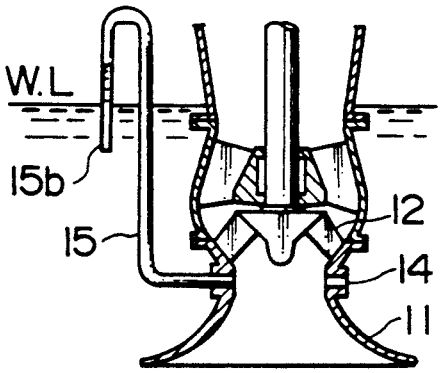
Figure 3E:
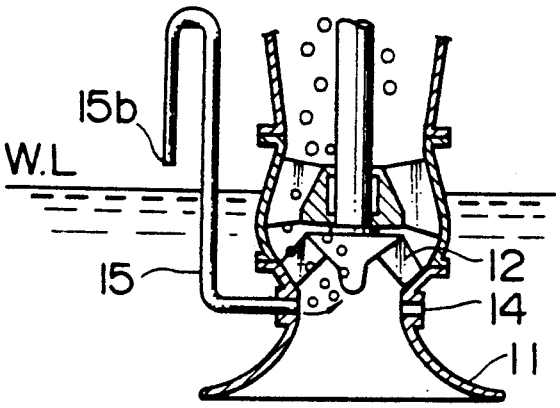
Figure 3F:
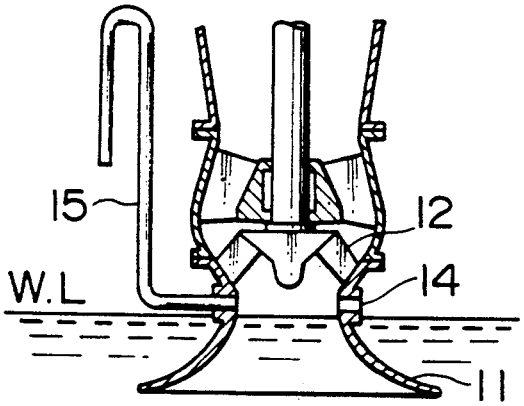
Figure 3G:
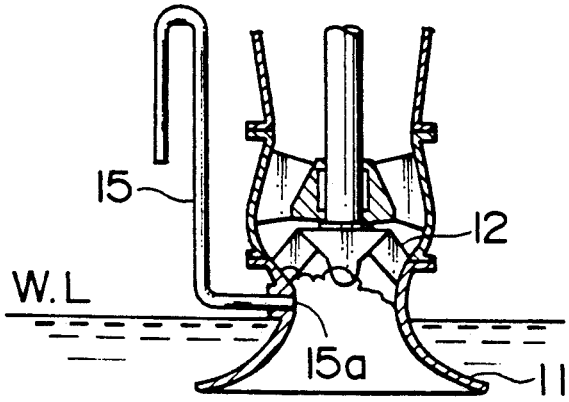

FIGS. 1 through 3 show a vertical shaft type axial flow pump according to this invention. The embodiment of the pump shown in these figures is used for drainage of rain water. Referring to FIGS. 1 and 2, a pump 10 has three small holes 14 having an area size equivalent to 0.5–3.0% of the area of a throat portion 13 near the entrance of an impeller 12 in a suction tube (cover) 11. Also, mounted is an air intake pipe 15 which has an opening at a base end 15*a* to the throat portion 13 at substantially the same level with the small holes 14 in the suction tube 11. The air intake pipe 15 has a size equivalent to 0.5–3.0% of the area of the throat portion 13. The end 15*b* of the air intake pipe 15 opens to the water level L.W.L at which air suction vortexes are not generated from the water surface W.L on the suction side when the pump is operated at a specified discharge rate of flow. The air intake pipe rises from the water level and is bent downwardly in an inverse U shape. The number of the small holes 14 and the number of the air intake pipes 15 may be single or plural. Reference numeral 16 denotes a main shaft, and 17 a guide vane.

As shown in FIG. 3(*a*), when the water level on the suction side, namely the suction water level W.L, is below the small hole 14, the inside of suction tube 11 is perfectly in the air-water separated condition, so that the pump operates stably in the air without intake of either air or water. Next, as shown in FIG. 3(*b*), when the suction water level W.L rises and reaches the lower end of the impeller 12, water suction from the suction tube 11 is started by the pumping action of the impeller 12. The pressure at the throat portion decreases by $^{a,v}$ 2/2 g, where $^{v}$ is the flow rate in pumping, $^{a}$ is the loss factor of pressure, and g is the acceleration of gravity. This means that the pressure at that portion is lower than the atmospheric pressure, and the air corresponding to the pressure difference &SP from the atmospheric pressure is sucked from the air intake pipe 15. This air sucked from the air intake pipe 15 blocks the passage between the vanes of the impeller 12, leading to the decrease in the discharge rate of flow of the pump. The pressure at the throat portion 13 becomes lower as the suction water level W.L is low. When the suction water level W.L is at the lower end of the impeller 12, water is pumped at, for example, only about 20% of the specified discharge rate of flow because of the suction of air; therefore, air suction vortexes are not generated at the water surface on the suction side, enabling stable operation with less vibration. When the suction water level rises further as shown in FIG. 3(*c*), the pressure at the throat portion 13 increases, so that the amount of air sucked from the air intake pipe 15 decreases, and the amount of water sucked through the suction tube 11 increases. As a result, the discharge rate of flow of the pump approaches a specified value.

When the suction water level W.L rises to a position above the end 15*b* of the air intake pipe 15 as shown in FIG. 3(*d*), air is not sucked at all because the end 15*b* of the air intake pipe 15 is submerged. As a result, the pump operates normally at a specified discharge rate of flow. Although there occur flows sucked from the air intake pipe 15 and the small holes 14 into the impeller 12, their amount is far smaller than the flow amount entering from the suction tube 11, so that no irregular flow is produced, and the pump performance is not affected at all.

Next, when the suction water level W.L lowers to a position below the end 15*b* of the air intake pipe 15 as shown in FIG. 3(*e*), air is sucked from the air intake pipe 15, so that the discharge rate of flow of the pump is decreased. Therefore, air suction vortexes are not generated from the water surface at the suction side even when the suction water level W.L is below the water level L.W.L. When the suction water level W.L lowers to a position below the small hole 14 as shown in FIG. 3(*f*), air enters through the air intake pipe 15 and the small holes 14, and air-water separation is performed at the lower end of the impeller 12, so that the impeller 12 rotates in the air. In this case, if the small holes are not provided and only the air intake pipe 15 is mounted, complete air-water separation does not happen because of the line resistance of the air intake pipe 15 and the blocking of the base end 15*a* due to the flow in the suction tube 11 as shown in FIG. 3(*g*). As a result, the hunting phenomenon takes place and pumping and air-water separation are alternately repeated, so that transient operation may continue. If a small hole 14 is provided, however, air-water separation is performed completely when the water level W.L is below the small hole 14, permitting stable operation in the air. The above-described phenomena were confirmed by performing continuous operation of an actual vertical shaft pump while moving up and down the water level on the suction side.

Thus, the vertical shaft pump of this invention can operate stably all the time under the normal condition without the air-water stirring at the impeller 12 or the generation of air suction vortexes at the water surface on the suction side irrespective of how far the suction water level W.L. lowers. Therefore, the pump of this type is suitable as a pump which must operate without decreasing its rotational speed even when the water level is below the impeller 12, such as pumps for draining rain water. The pump of this invention requires no special operation or tools, such as the rotational speed control of the pump and the control of the opening degree of a discharge valve in response to changes in suction water level, and provides nearly the same service life and reliability as those of the conventional pump of this type even if it is used under harsh conditions.

Figure 4:
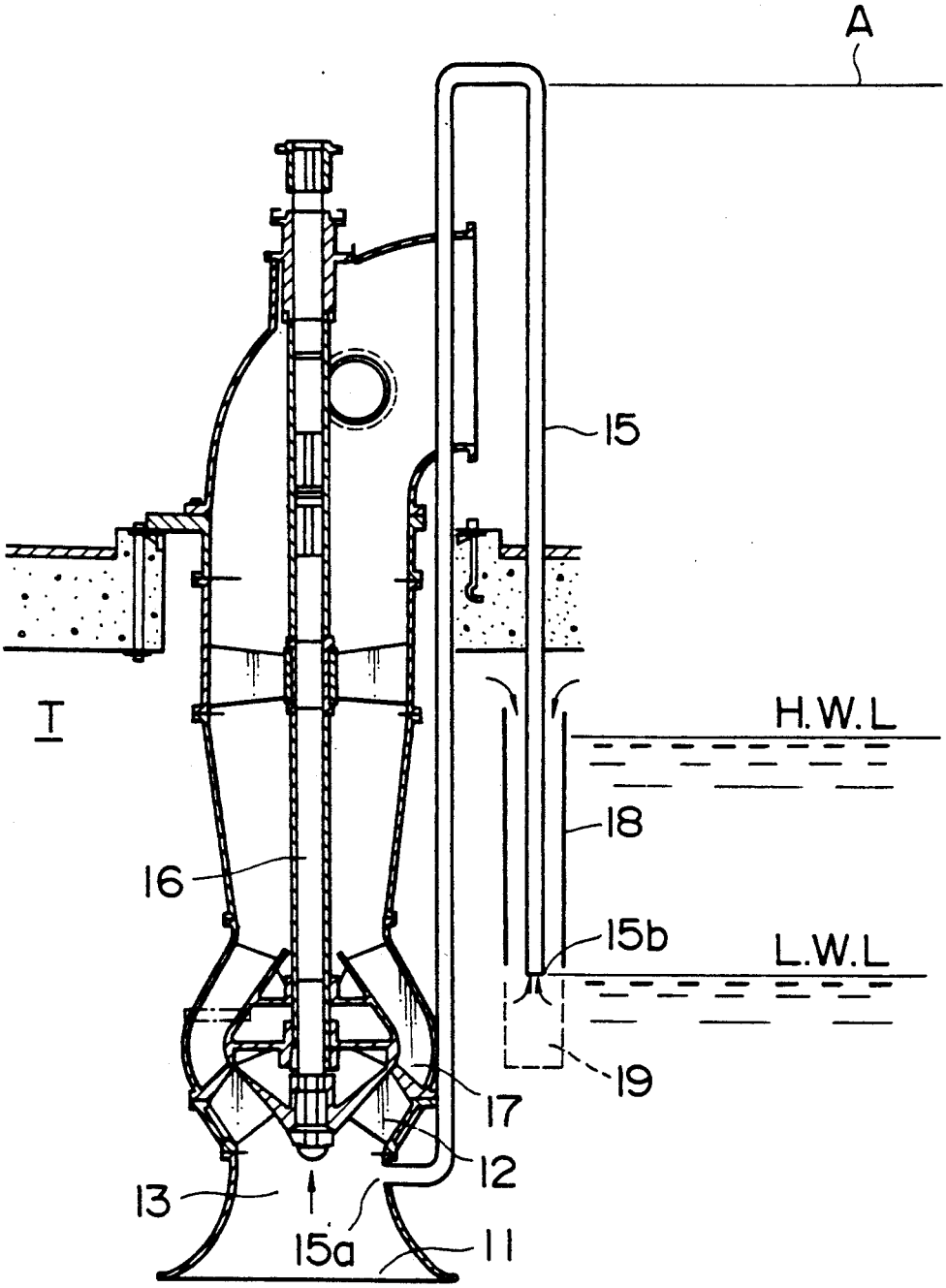
FIG. 4 is a longitudinal cross-sectional view of the improvement of the vertical shaft type axial flow pump of the first embodiment.

FIG. 4 shows an improvement of the above embodiment of the pump.

According to this embodiment, an air intake pipe 15 rises to a high position A where liquid does not flow in the pipe, and then is bent downward from the top, its end 15*b* opening to the set low water level L.W.L of the intake chamber T. Around the end 15*b*, a cylinder 18 with its both ends open is coaxially disposed with a gap for permitting air to flow between the air intake pipe 15 and the cylinder 18. At the lower end of the cylinder 18, a strainer which can suck liquid is mounted. The upper end of the cylinder 18 opens to a position higher than the highest water level H.W.L at which the pump can suck water.

In this arrangement, the rain water or sewage flowing through a suction tube 11 passes through a throat portion 13, is pressurized by the impeller 12, and is discharged through a guide vane 17. Since the end 15*b* of the air intake pipe 15 opens at the position of the low water level L.W.L at which air suction is necessary, air suction is performed only when the water level is lower than the L.W.L. In this case, the strainer 19 mounted at the position of end 15*b* prevents foreign matters on the water surface from entering the air intake pipe 15. Although the strainer 19 sometimes has a high resistance due to foreign matters, air can be sucked from the upper opening of the cylinder 18 in this case; therefore, shortage of suction air does not occur.

When the water level is higher than the L.W.L, the water in the intake chamber T is sucked into the air intake pipe 15 through the opening of the strainer 19. In this case, air is not sucked into, and no effect of air entrance is observed. Therefore, prescribed pumping is carried out through the suction tube 11, and the specified pumping performance can be achieved. Since the air intake pipe rises up to a high position A where liquid does not flow in the pipe, the amount of water flow from the strainer 19 is very small, which prevents the strainer 19 from clogging due to the suction of liquid. Even if the strainer 19 clogs to some degree, the performance is not impaired. For these reasons, even if foreign matters enter the water flowing into the suction chamber T, the function of air intake pipe 15 is not impaired, and sound pump operation becomes possible at any water level.

Figure 5:
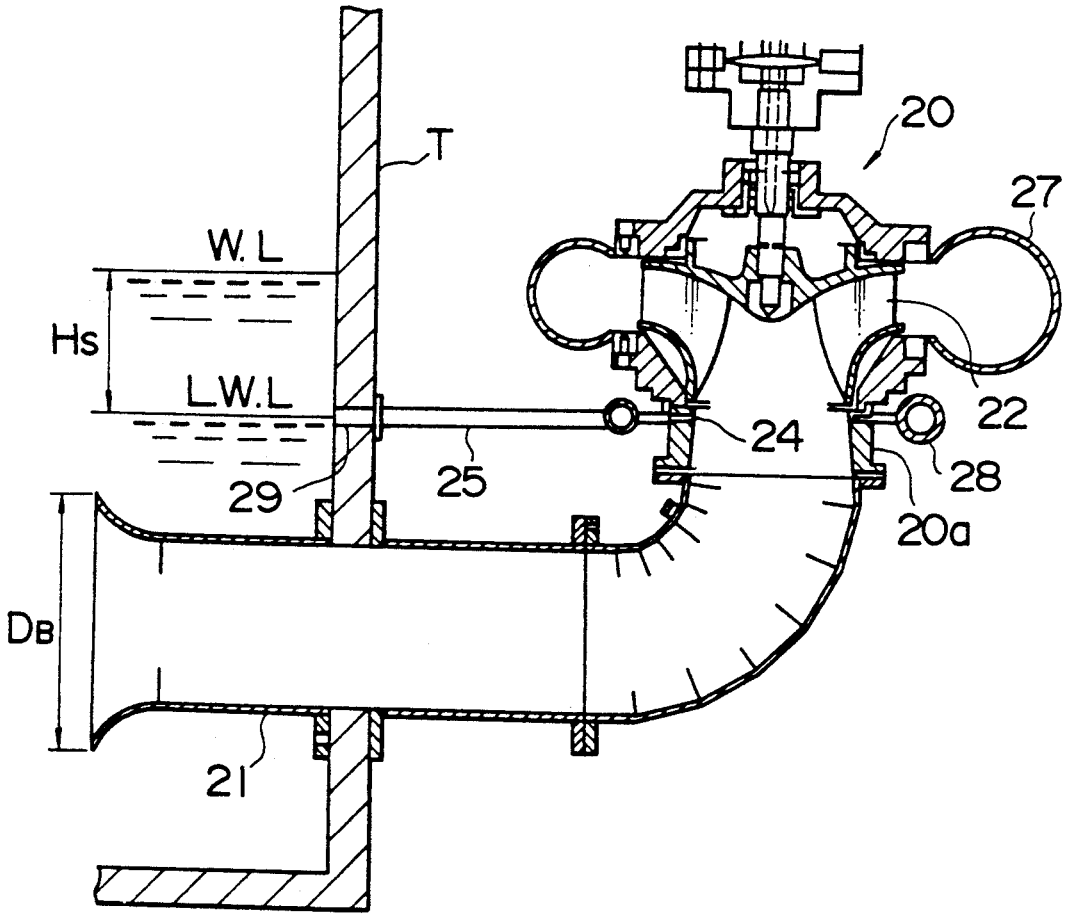
FIG. 5 is a longitudinal cross-sectional view of a second embodiment of a vertical shaft type volute pump for drainage according to this invention.
Figure 6:
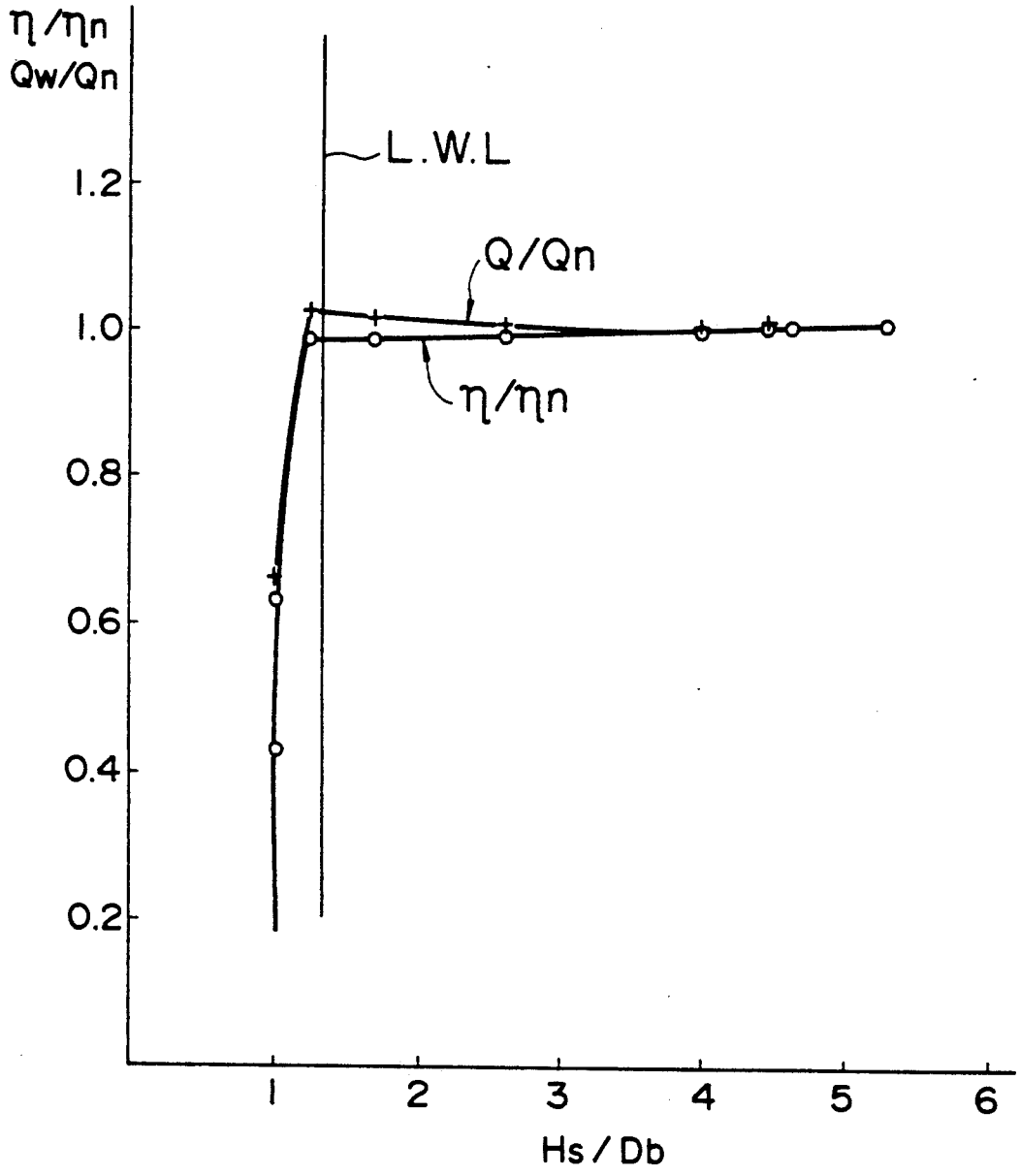
FIG. 6 is a graph for explaining the operation of the pump.

FIG. 5 is a sectional view of another embodiment of this invention for explaining the construction of a dry pit type pump. FIG. 6 is a graph for explaining the operation of the pump. Referring to FIG. 5, the dry pit type pump of this invention is a volute pump used for moving sewage water. As shown in the figure, the pump 20 is installed outside the intake chamber T. This pump sucks sewage in the intake chamber T through a suction tube 21 passing through the side wall of intake chamber T. The sewage is pressurized by an impeller 22 and discharged through a scroll chamber 27. W.L denotes the water level of sewage flowing into the intake chamber T, namely the suction water level of the pump 20, and L.W.L denotes the lowest water level at which the pump can be operated without producing air suction vortexes and submerged vortexes. In the suction casing 20*a* immediately under the entrance of the impeller 22, a plurality of air suction holes 24 are drilled in the radial direction, which are connected to each other by a ring tube 28. The side wall of intake chamber T has a through hole drilled at a height corresponding to the lowest suction water level L.W.L, which is in communication with the ring tube 28 through an air intake pipe. It is not particularly necessary that the air suction holes 24 of the suction casing are at the same level with the through hole 29 of the intake chamber T. It does not matter which of them is higher because the level of the opening of an air intake pipe 25 is determined from the height of the through hole 29. The pump may be a mixed flow pump or a pump of other type.

The pressure at the air suction holes 24 immediately under the impeller 22 is determined by the water level W.L and the pressure loss at the suction tube 21. When the water level W.L is below the lowest water level L.W.L, air is sucked through the air intake pipe 25 by the pressure difference between the pressure at the air suction holes 24 and the atmospheric pressure. The amount of suction air $Q_a$ is expressed by the following equation:

$$Q_a = \alpha\left(\frac{H_b - H_i}{\xi}\right)^{\frac{1}{2}} \tag{1}$$

where, $\alpha$ and $\xi$ are coefficients depending on the air intake pipe 25, $H_b$ is the atmospheric pressure, and $H_i$ is the static pressure at the air suction holes 24. The air suction ratio A is expressed by the following equation:

$$\begin{aligned} A &= Q_a/Q_W \\ &= (\beta - \gamma * H_s/Q_W^2)^{\frac{1}{2}} \end{aligned} \tag{2}$$

where, $Q_W$ is the pump discharge, $\beta$ and $\gamma$ are constants determined from the cross sectional area and the pressure loss factor of the suction tube 21 and the air intake pipe 25, $H_s$ is the level difference between the water level W.L and the air suction hole 24. The pump discharge $Q_W$ determines the level difference $H_s$ in which the static pressure $H_i$ is negative in relation to the atmospheric pressure $H_b$. Therefore, if the pump discharge QW is large, the static pressure $H_i$ at the air suction hole 24 is negative even when the water level is considerably high. As shown in FIG. 6, when the water level W.L is below the lowest suction water level L.W.L, air is sucked through the through hole 29, air intake pipe 25, ring tube 28, and air suction holes 24, leading to the reduction in the pump discharge $Q_W$. In FIG. 6, $\eta$ is the pump efficiency, $\eta_n$ and $Q_n$ are the efficiency and the pump discharge, respectively, in the case where the water level is sufficiently high, and $D_b$ is the bellmouth diameter of the suction tube 21.

On this pump, the through hole 29 in the side wall of intake chamber T is installed at the height corresponding to the lowest suction water level L.W.L, and this through hole connects to the air suction holes 24 installed in the suction casing immediately under the entrance of impeller 22 through the air intake pipe 25. Since the opening of the air intake pipe 25, namely the through hole 29, is in the water when the water level is high though the static pressure $H_i$ at the air suction holes is negative even when the water level is considerably high, the sewage in the intake chamber T flows into the air intake pipe 25, but the performance of the pump is not deteriorated. When the water level W.L is below the lowest suction water level L.W.L, air suction is performed through the air suction pipe 25, so that the pump discharge $Q_W$ suddenly decreases. As a result, the pump can operate safely without reducing its rotational speed because there is no risk of producing air suction vortexes and submerged vortexes. When the water level lowers to a point where the pump discharge $Q_a$ is about 10–20% of a specified rate of flow of the pump, the pumped water at the suction casing immediately under the entrance of the impeller 22 separates into two phases of air and liquid, which makes the pumping operation impossible. Thus, the pump performs a quiet holding operation. When the water level rises from this condition up to the lowest suction water level L.W.L at which the pump operates safely at a specified discharge rate of flow, the pump starts pumping operation.

Figure 7:
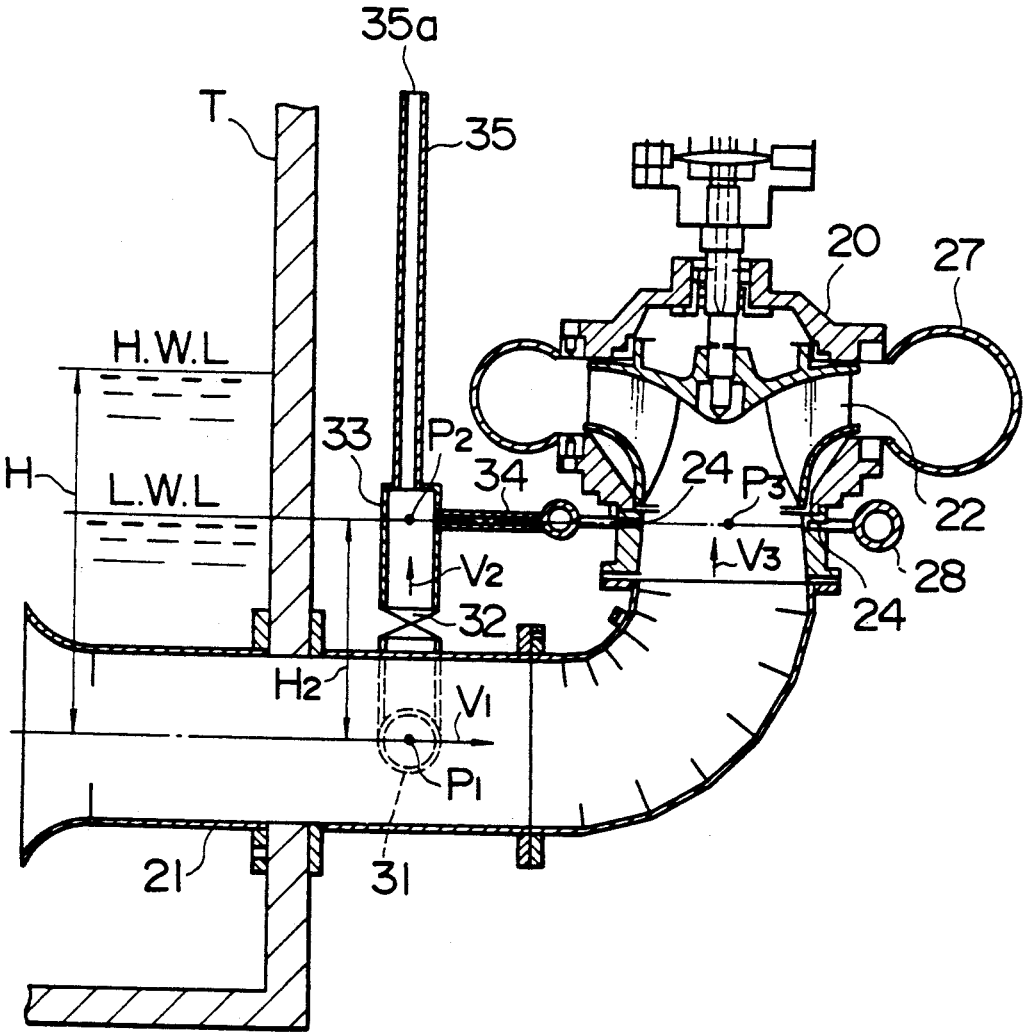
FIG. 7 is a longitudinal cross-sectional view of a further improvement of the vertical shaft type volute pump of the second embodiment.
Figure 8:
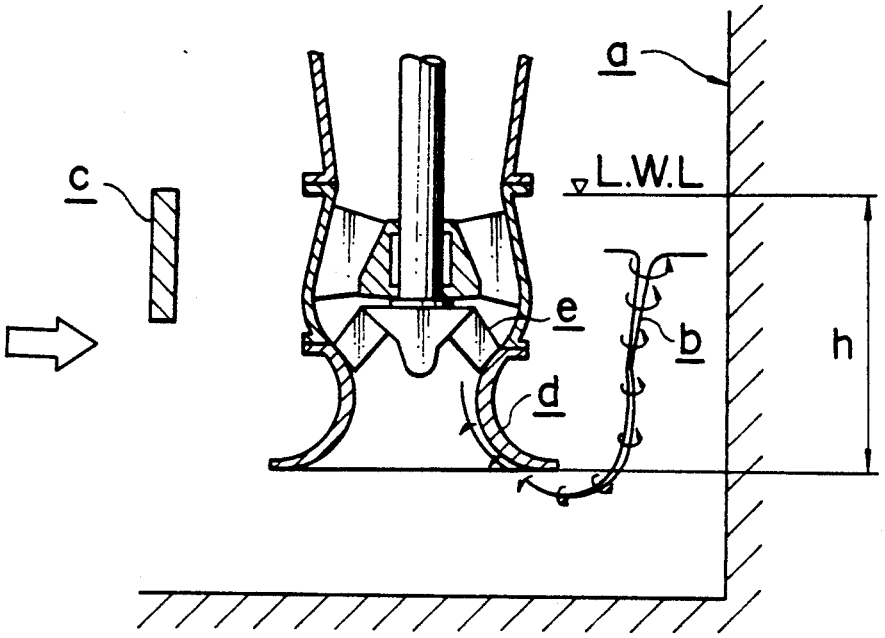
FIG. 8 PRIOR ART
FIG. 8 is a cross-sectional view of a conventional vertical shaft type axial flow pump.
Figure 9:
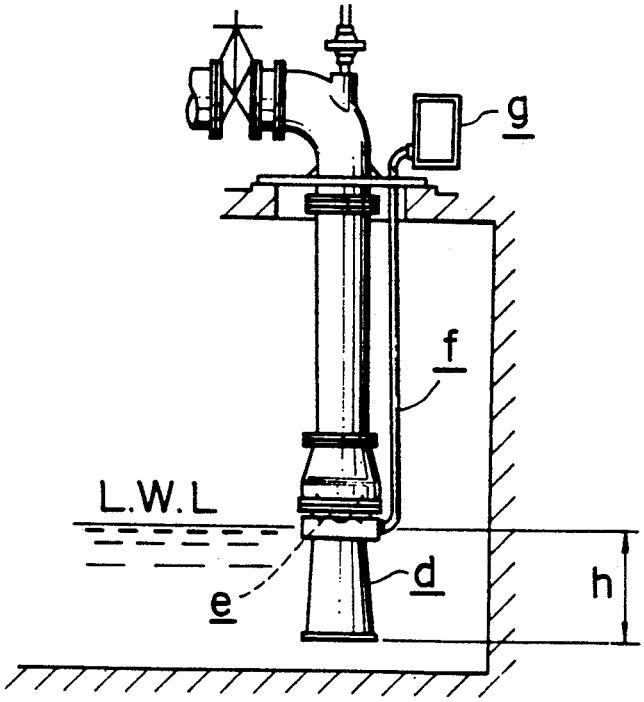
FIG. 9 PRIOR ART
FIG. 9 is a front elevational view of an improvement of the conventional vertical shaft type axial flow pump.
Figure 10:
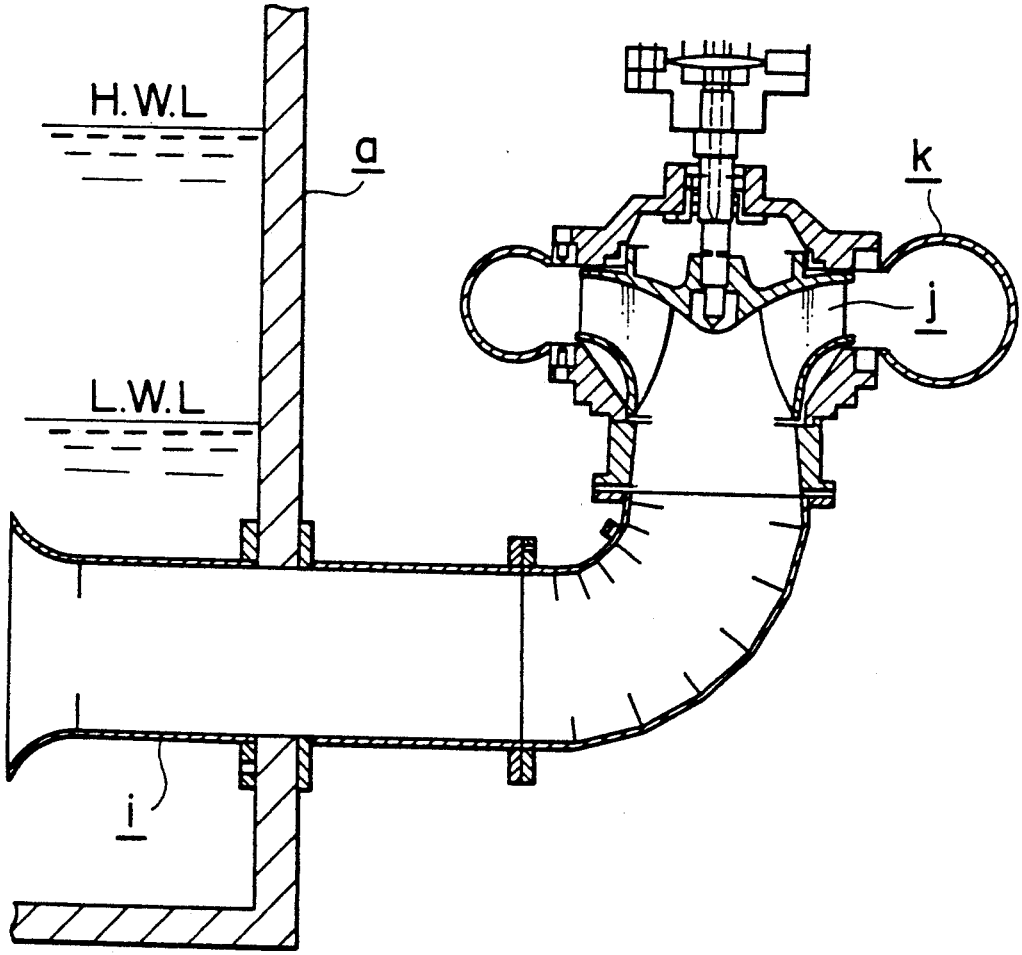
FIG. 10 PRIOR ART
FIG. 10 is a longitudinal cross-sectional view of a conventional vertical shaft type volute pump.

FIG. 7 shows an improvement of the above-described volute type mixed flow pump. In the volute type mixed flow pump shown in FIG. 7, a first branch pipe 31 is connected in the horizontal direction midway in the suction tube 21 protruding into the intake chamber T. This first branch pipe 31 is raised vertically and connected to a main valve 32. The main valve 32 is connected to a second branch pipe 33. The branch point of the second branch pipe 33 lies at the position of the water level L.W.L requiring air suction. From this branch point, a small-diameter branch pipe 34 extends horizontally so as to connect to the ring tube 28 which is in communication with the air suction holes 24 of the suction casing. The second branch pipe 33 is connected to an air intake pipe 35 extending vertically. The end 35*a* of the air intake pipe 35 opens at a position higher than the highest suction water level H.W.L.

On the volute type mixed flow pump of this invention shown in FIG. 7, the pressure $P_1$ at the first branch point, the pressure $P_2$ at the second branch point, and the pressure $P_3$ at the suction casing are expressed as follows:

$$P_1/\gamma = H - \xi_1 * V_1^2/2g \quad (3)$$
$$P_2/\gamma = (H - H_2) - (\xi_1 * V_1^2/2g + \xi_2 * V_2^2/2g) \quad (4)$$
$$P_3/\gamma = (H - H_2) - (\xi_1 * V_1^2/2g + \xi_3 * V_3^2/2g) \quad (5)$$

where, $\gamma$ is the specific gravity of liquid, H is the height from the centerline of suction tube 21 to the highest suction water level H.W.L, $H_2$ is the height from the centerline of suction tube 21 to the water level L.W.L requiring air suction, $\xi_1$ is the loss factor from the entrance of suction tube 21 to the first branch point, $\xi_2$ is the loss factor from the first branch point to the second branch point, $\xi_3$ is the loss factor from the first branch point to the suction casing, $V_1$ is the velocity of the main flow at the first branch point in the suction tube 21, $V_2$ is the velocity of fluid in the second branch pipe, and $V_3$ is the velocity of the main flow at the suction casing.

When the water level is high, the main flow at the suction casing is made by the pressure difference ($P_1$–$P_3$) between the pressure $P_1$ at the first branch point and the pressure $P_3$ at the suction casing, the velocity of the main flow being $V_3$. In the branch pipe 34, water also flows by the pressure difference ($P_2$–$P_3$) between the pressure $P_2$ at the second branch point and the pressure $P_3$ at the suction casing. Since the loss factor including the air suction holes 24 of the small-diameter branch pipe 34 is higher than the loss factor $\xi$ of the main flow, the amount of water flowing in the branch pipe 34 is small.

Here, we will consider the case where foreign matters flow. The first branch pipe branches in the horizontal direction, and water flows by the pressure difference ($P_1$–$P_2$) between the pressure $P_1$ at the first branch point and the pressure $P_2$ at the second branch point with a low flow velocity of $V_2$. Therefore, it is difficult for foreign matters to enter the first branch pipe 31. Even if it enters, sludge and the like will settle at the position where the pipe rises vertically because the velocity $V_2$ is low. If the pipe is clogged by foreign matters, maintenance work can be easily carried out by closing the main valve.

Air is sucked when the pressure $P_2$ becomes a negative pressure. The condition of air suction is expressed as follows:

$$(H - H_2) < (\xi_1 * V_1^2/2g + \xi_2 * V_2^2/2g) \quad (6)$$

In the case of air suction, since the second term at the right side of Equation (6) is zero, the relation between the water level at which air suction is desired and the discharge Q is determined from the following equation:

$$H_2 = H - \xi_1/2g(Q/A_1)^2 \quad (7)$$

where, $A_1$ is the sectional area of the suction tube 21.

We claim:

1. A vertical shaft type axial flow liquid pump comprising:

a pump casing having a liquid intake suction tube section having an inlet end for immersion in said liquid, an impeller section adjacent said intake section and a discharge section downstream of said impeller section;

an impeller in said impeller section for pumping liquid through said casing;

a substantially vertical shaft connected to said impeller for driving said impeller;

a plurality of air intake holes through said suction tube section proximate said impeller; and an air intake pipe having an outlet end connected to one of said holes and an inlet end positioned at a preset lowest suction liquid level of said liquid, so that when the level of said liquid drops below said holes air enters the other of said holes to provide air and liquid separation in said suction tube section for stable operation of said pump.

* * * * *